US005967340A

United States Patent [19]

Kao

[11] Patent Number: 5,967,340

[45] Date of Patent: Oct. 19, 1999

[54] TOOL RACK HAVING SLIDABLE CONNECTORS

[76] Inventor: Jui-Chien Kao, No. 358, Tunghsing Rd., Shuwang Li, Tali City, Taichung Hsien, Taiwan

[21] Appl. No.: 09/132,229

[22] Filed: Aug. 11, 1998

[51] Int. Cl.[6] ..... A47F 7/00; A47F 5/00; B65D 73/00

[52] U.S. Cl. ..... 211/70.6; 206/493; 294/146; 294/162

[58] Field of Search ..... 211/70.6; 206/373, 206/376, 378, 379, 493; 294/146, 159, 161, 162, 163

[56] References Cited

U.S. PATENT DOCUMENTS 5,346,063 9/1994 Chow ..... 211/70.6 X 5,598,924 2/1997 McCann ..... 211/70.6 X 5,862,913 1/1999 Chou ..... 211/70.6 X

*Primary Examiner*—Daniel P. Stodola

*Assistant Examiner*—Erica B. Harris

*Attorney, Agent, or Firm*—Rosenberg, Klein & Bilker

[57] ABSTRACT

A tool rack includes a body having a head portion and a board extending from the head portion, the board having two rails extending from two sides thereof so that a plurality of connectors are slidably mounted to the two rails. Each of the connectors has two plates and each of the plates has a recess defined therein so that a tool is received in the recesses of the two plates. A stop member is connected to the free end of the board and blocks the two rails to prevent the connectors from being removed from the rails. A limit member is mounted to the board so as to keep the tools on the connectors from being removed.

9 Claims, 6 Drawing Sheets

TOOL RACK HAVING SLIDABLE CONNECTORS

FIELD OF THE INVENTION

The present invention relates to a tool rack, and more particularly, to a tool rack having two rails located on two sides of the rack and a plurality of slidable connectors slidably mounted therebetween so that tools are connected to the connectors.

BACKGROUND OF THE INVENTION

A conventional tool rack is shown in FIG. 6 and comprises a body 10 having a slot 100 defined in one of two ends thereof and two flanges 11 respectively extending from two sides thereof each of the two flanges 11 has a plurality of recesses 12 defined therein and each periphery defining the respective recess 12 has an opening defined by two protrusions 120, 121 so that a tool 20 such as a wrench is force-fit into the recess 12 by passing through the opening between the two protrusions 120, 121. Every two opposite recesses 12 on the two flanges 11 has a flexible plate 13 formed therebetween so that when the tool 20 is received in the two recesses 12, the flexible plate 13 is compressed by the tool 20 and provides an upward force against the tool 20 to securely hold the tool 20. However, such a tool rack has no suitable antitheft means so that when the tool rack is displayed in a hardware store, tools 20 on the rack could be taken from the rack directly so that the dealers tend to pack up the tool rack with the tools. Further cost is therefore incurred. In addition, the shapes of the recesses 12 are unchanged so that a tool with a circular cross-section cannot be used with the tool rack.

The present invention provides a tool rack which has two rails with a plurality of connectors slidably and changeably mounted therebetween, and a limit plate connected to the rack so that the tools on the rack cannot be taken away unless the limit plate is removed. The tool rack arose to mitigate and/or obviate the disadvantages of the conventional tool rack.

SUMMARY OF THE INVENTION

In accordance with one aspect of the present invention, a tool rack is provided and comprises a body having a head portion with an aperture defined therethrough, and a board extending from the head portion with two first engaging means extending from two sides of the board. At least one connector has two second engaging means defined in two ends thereof so as to slidably mount to the two first engaging means, two plates extending from at least one connector and each of the plates having a recess defined therein. A stop member is removably connected to the free end of the board and is sized to block the two rails to prevent at least one connector from being removed from the rails.

An object of the present invention is to provide a tool rack having slidable and changeable connectors to which tools are connected.

Another object of the present invention is to provide a tool rack having an antitheft means connected thereto.

Further objects, advantages, and features of the present invention will become apparent from the following detailed description with appropriate reference to the accompanying drawings.

DETAILED DESCRIPTION OF THE PREFERRED EMBODIMENTS

Figure 1:
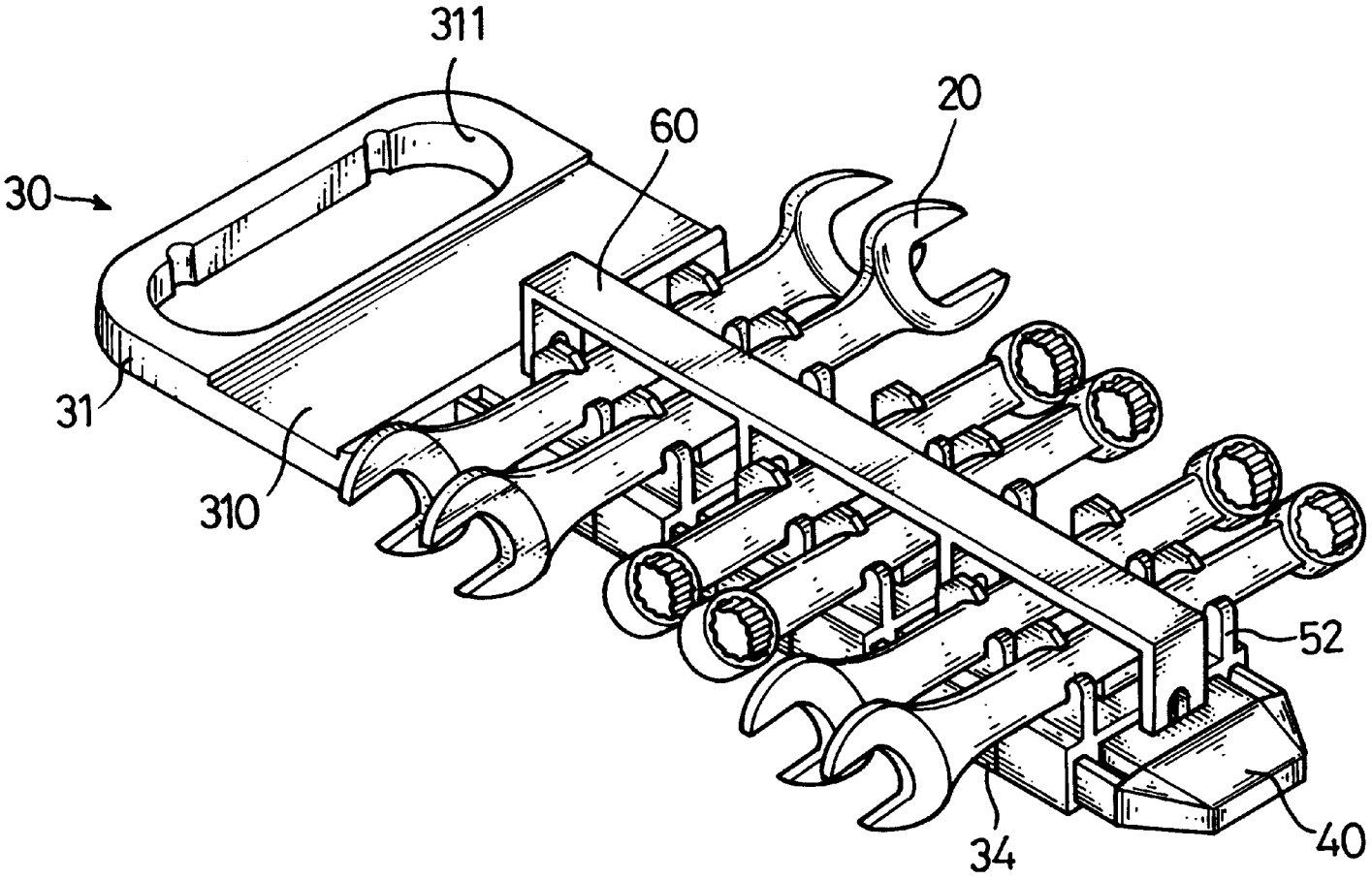
FIG. 1 is a perspective view of the tool rack of the present invention and the tools connected thereto.
Figure 2:
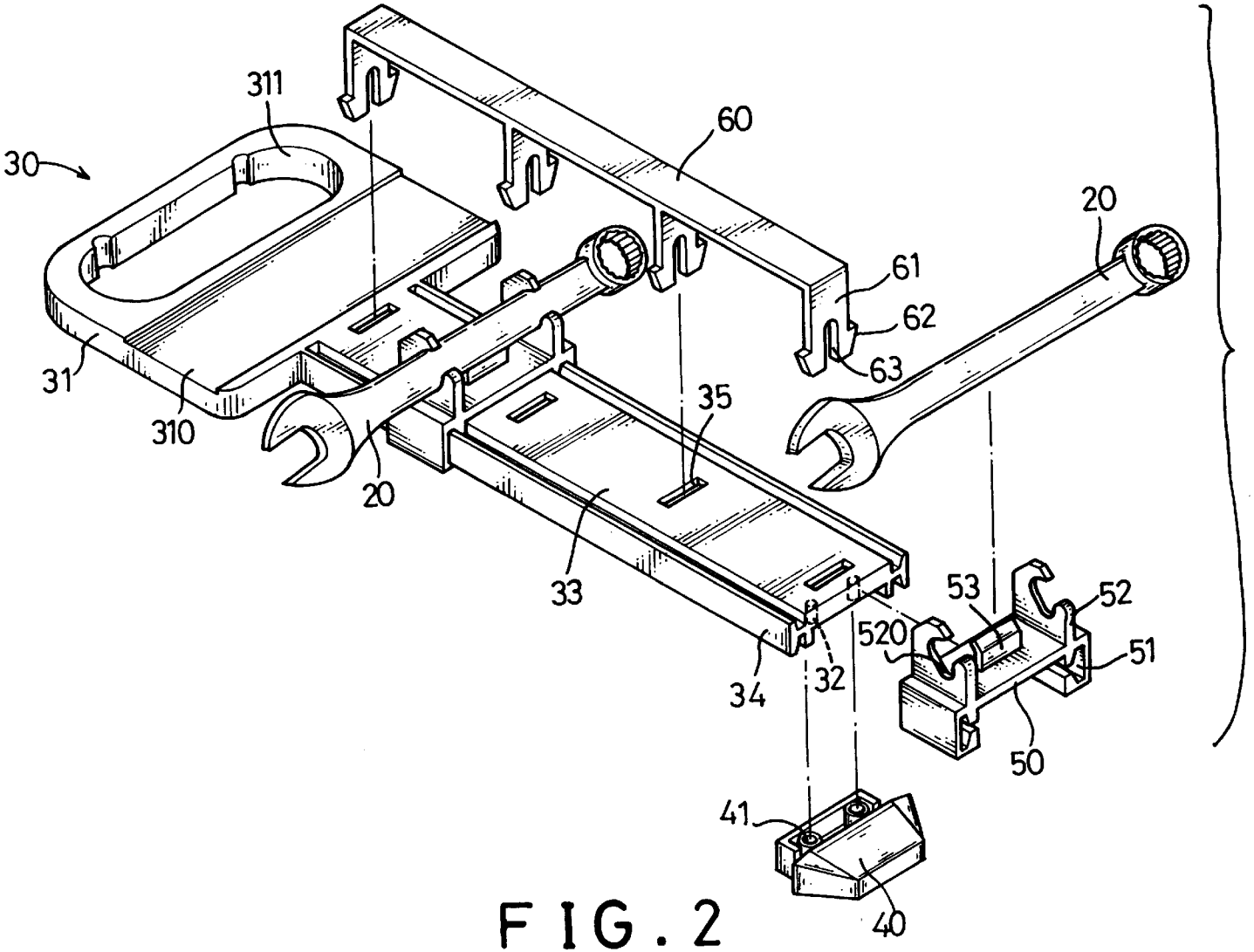
FIG. 2 is an exploded view of the tool rack in accordance with the present invention.
Figure 3:
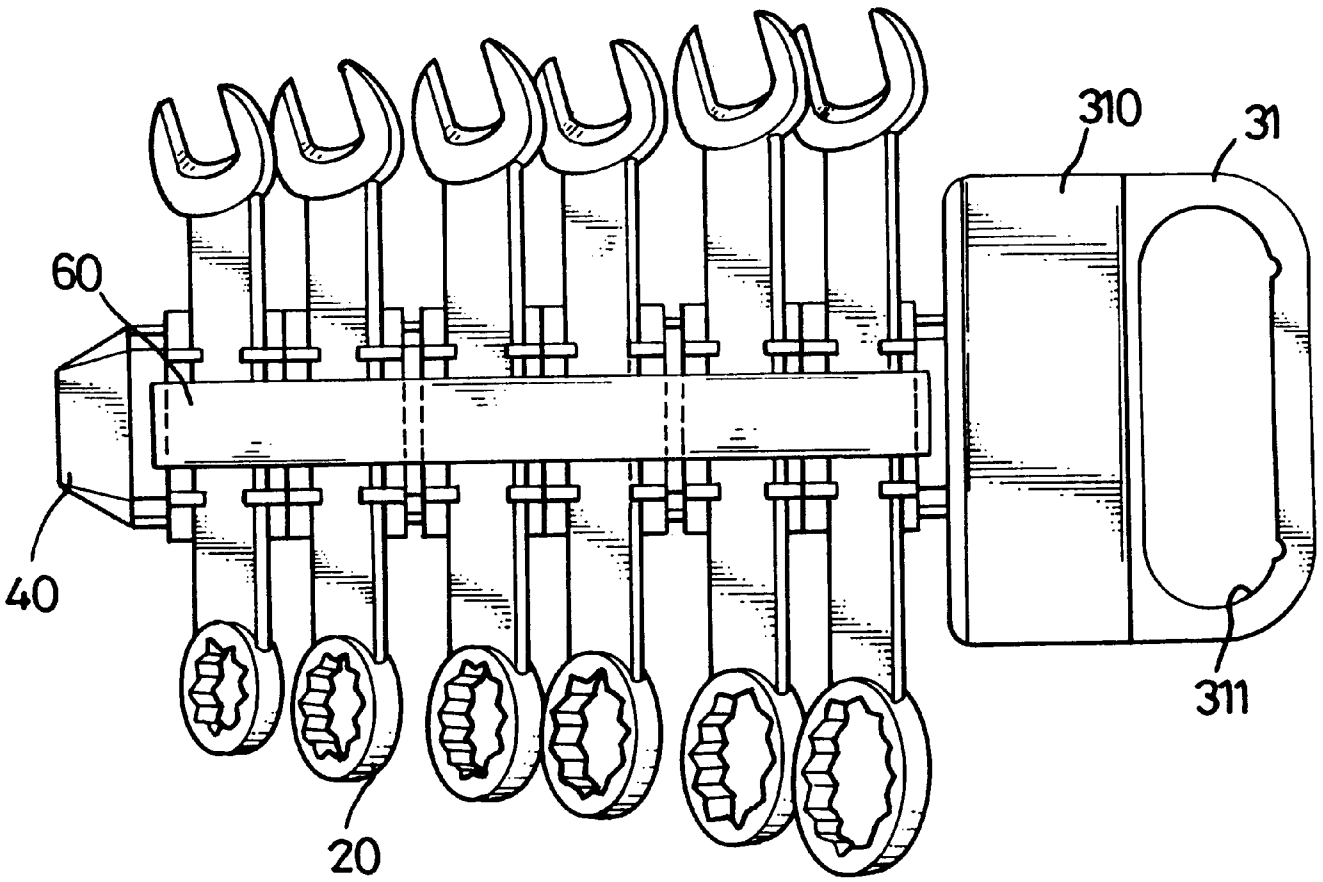
FIG. 3 is a top view to show the tool rack and the tools on the rack of the present invention.

For a better understanding of the present invention, reference is made to FIGS. 1 to 3, illustrating the tool rack in accordance with the present invention. The tool rack comprises a body 30 having a head portion 31 through which an aperture 311 is defined, and a board 33 extending from the head portion 31. The head portion 31 has a recessed area 310 defined therein so as to receive a description card or the like therein and the board 33 has a fixed width. Two first engaging means, such as two rails 34 extend from two sides of the board 33 and two rods 32 respectively extend from the underside of the free end of the board 33. The board 33 further has four slots 35 defined therethrough.

A plurality of connectors 50 each have two second engaging means, such as grooves 51 defined in two ends thereof so as to slidably mount to the two rails 34. Two plates 52 extend from each of the connectors 50 and each of the plates 52 has a recess 520 defined therein such that a tool such as a wrench 20 is received in the two recesses 520 in the two plates 52.

A stop member 40 has two tubes extending therefrom so that the stop member 40 is removably connected to the free end of the board 33 by inserting the two rods 32 into the two holes 41 defined in the two tubes. The stop member 40 is sized to block the two rails 34 to prevent the connectors 50 from being removed from the rails 34.

Figure 4:
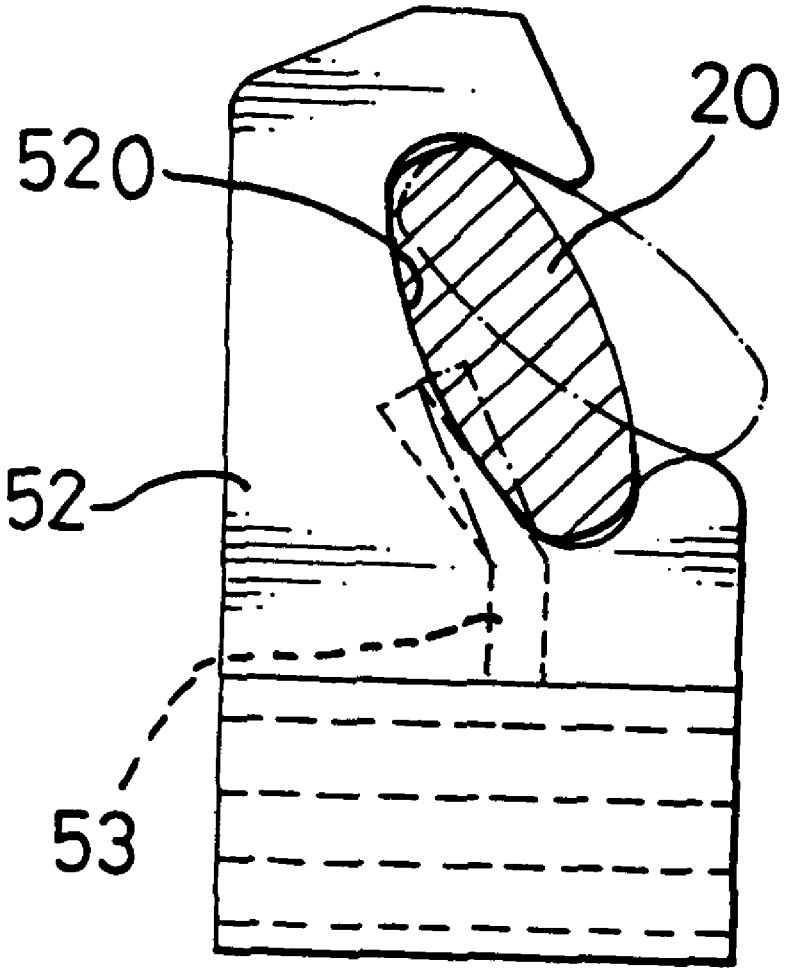
FIG. 4 is a side elevational view, partly in section, to show how the tool is received in the connector of the present invention.

Referring to FIG. 4, a flexible plate 53 extends from each of the connectors 50 and is located between the two plates 52 so that when the tool 20 is received in the two recesses 520, the tool 20 compresses the flexible plate 53 which provides an upward force against the tool 20.

A limit member 60 has a plurality of insertions 61 extending therefrom and each of the insertions 61 has two hooks 62 separated by a gap 63 defined therebetween. The two hooks 62 are engaged with the slot 35 corresponding thereto in the board 33 so as to mount the limit member 60 to the board 33 and the limit member 60 is located between the two first engaging means 34. The limit member 60 cannot be removed from the board 33 unless the hooks 62 are cut so that the limit member 60 provides an antitheft function for the tools 20 connected to the rack.

Figure 5:
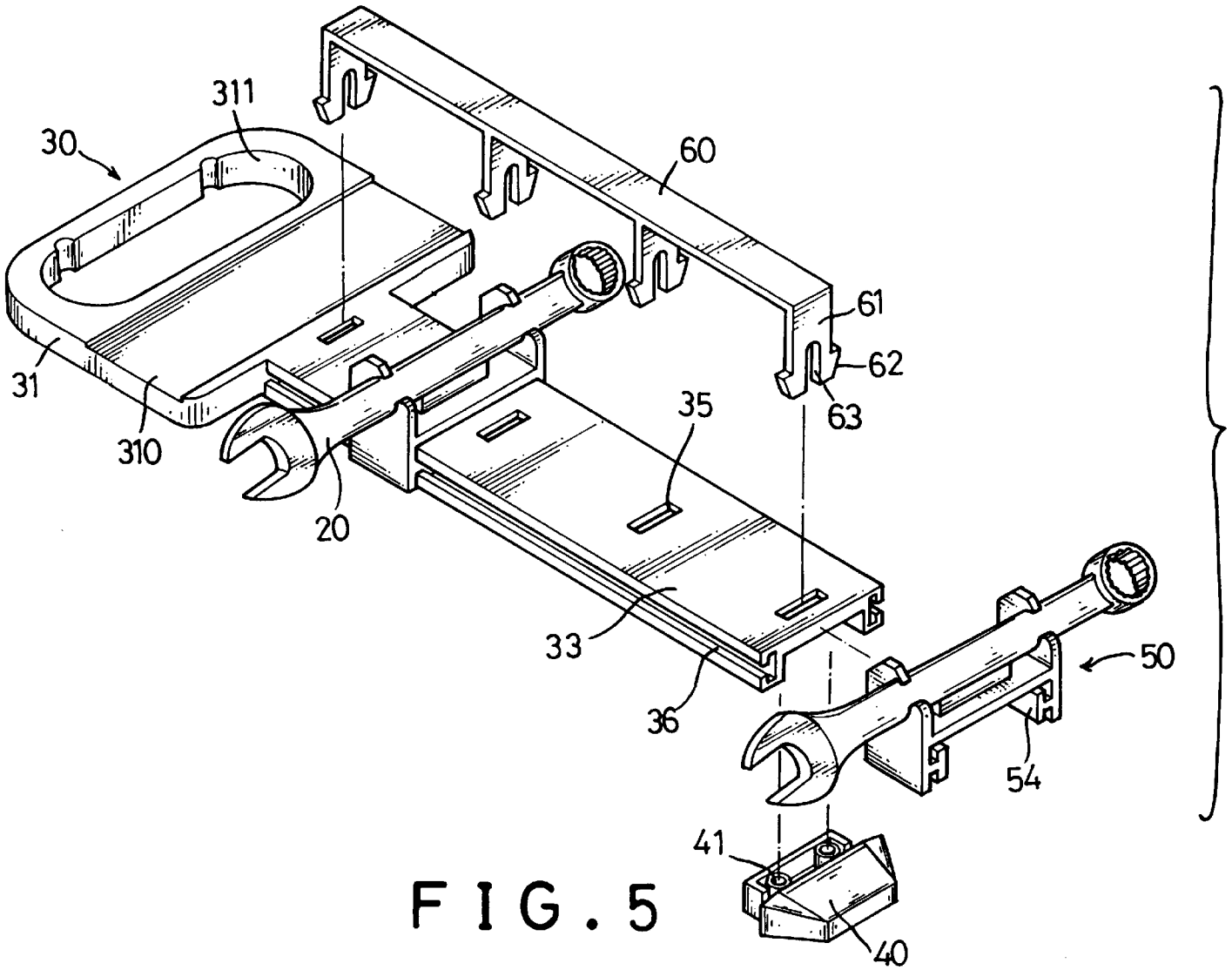
FIG. 5 is an exploded view to show another embodiment of the tool rack of the present invention.
Figure 6:
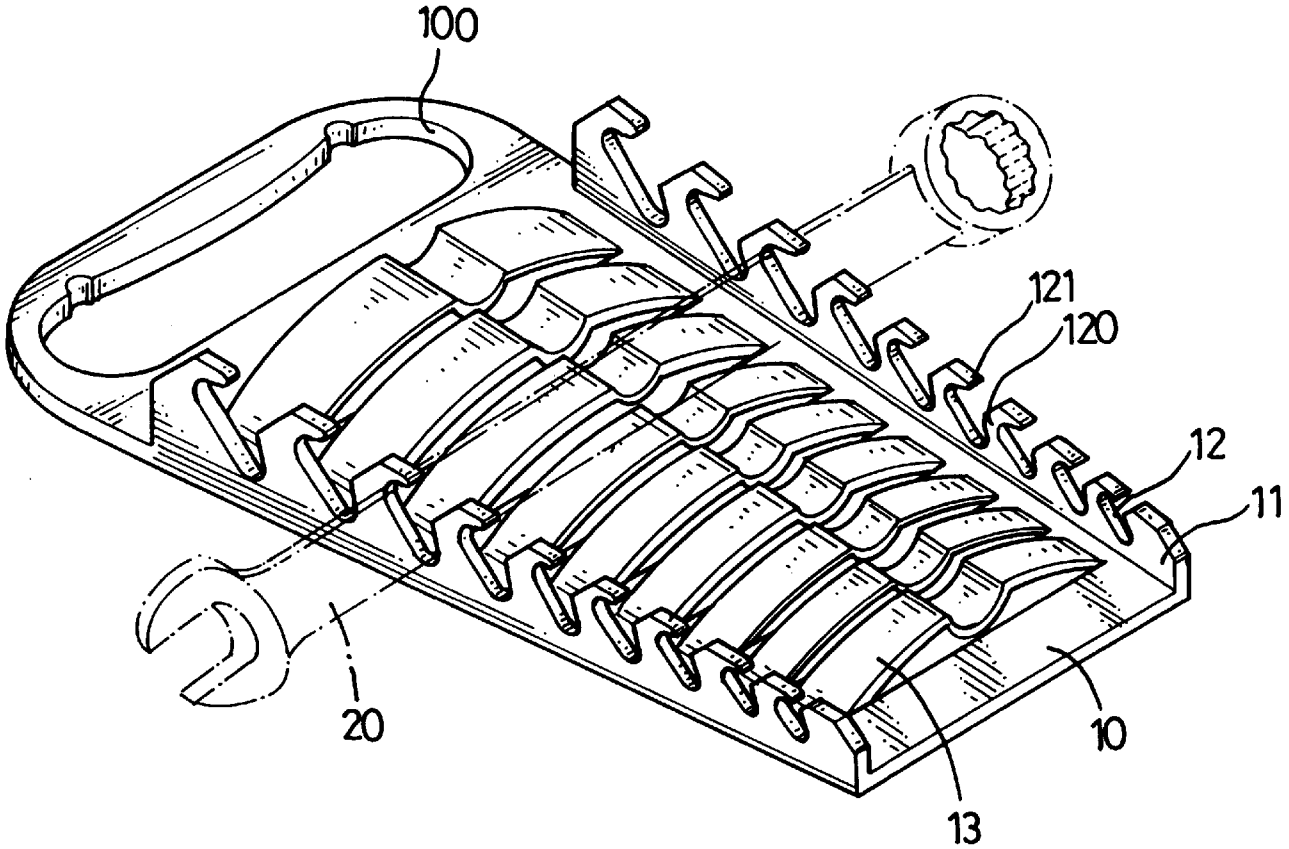
FIG. 6 PRIOR ART
FIG. 6 is a perspective view of the conventional tool rack.

FIG. 5 shows another embodiment of the tool rack of the present invention, wherein the board 33 has two grooves 36 defined in two sides thereof and each of the connectors 50 has two rails 54 which is received in the two grooves 36.

The connectors 50 can be replaced according to the users' needs and the shapes of the recesses 520 may be of various types so as to receive different types of tools therein.

Although the invention has been explained in relation to its preferred embodiment, it is to be understood that many other possible modifications and variations can be made without departing from the spirit and scope of the invention as hereinafter claimed.

What is claimed is:

1. A tool rack comprising:

a body having a head portion with an aperture therethrough, and a board extending from said head portion, two first engaging means extending from two sides of said board such that each engaging means encompasses an end portion of a front and rear surface of said board;

at least one connector having two second engaging means defined in two ends thereof slidably mounting said at least one connector to said two first engaging means, two plates extending from at least one of said at least one connector and each of said plates having a recess defined therein, and a stop member removably connected to said board at a free end of said board and being sized to block said first engaging means to prevent said at least one connector from being removed from said first engaging means.

2. The tool rack as claimed in claim 1, wherein said board has a fixed width.

3. The tool rack as claimed in claim 1 further comprising two rods extending from the underside of the free end of said board and said stop member having two holes defined therein so as to receive said two rods therein.

4. The tool rack as claimed in claim 1 further comprising a flexible plate extending from at least one said connector and located between said two plates.

5. The tool rack as claimed in claim 1, wherein each of said first engaging means is a rail and each of said second engaging means is a groove.

6. The tool rack as claimed in claim 1, wherein each of said first engaging means is a groove and each of said second engaging means is a rail.

7. The tool rack as claimed in claim 1 further comprising a recessed area defined in said head portion.

8. The tool rack as claimed in claim 1 further comprising a limit member mounted to said board and located between said two first engaging means, said limit member having a plurality of insertions extending therefrom and said board having a plurality of slots defined therethrough so as to receive said insertions.

9. The tool rack as claimed in claim 8, wherein each of said insertions has two hooks separated by a gap defined therebetween, said two hooks engaged with said slot corresponding thereto.

* * * * *